US008045891B2

(12) United States Patent
Nishi et al.

(10) Patent No.: US 8,045,891 B2
(45) Date of Patent: Oct. 25, 2011

(54) ROTARY DEVELOPING APPARATUS ROTATABLY ACCOMMODATING A PLURALITY OF DEVELOPER UNITS, DEVELOPER UNIT AND IMAGE FORMING APPARATUS INCLUDING ROTARY DEVELOPING APPARATUS

(75) Inventors: Masayuki Nishi, Toyokawa (JP); Tsugihito Yoshiyama, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 406 days.

(21) Appl. No.: 12/102,559

(22) Filed: Apr. 14, 2008

(65) Prior Publication Data

US 2009/0047042 A1 Feb. 19, 2009

(30) Foreign Application Priority Data

Aug. 17, 2007 (JP) ..... 2007-212885

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS

| | | | | |
|---|---|---|---|---|
| 5,600,431 | A * | 2/1997 | Takeda et al. | 399/226 |
| 2004/0184837 | A1 * | 9/2004 | Kinouchi | 399/227 |

FOREIGN PATENT DOCUMENTS

| | | | |
|---|---|---|---|
| JP | 61-217072 | | 9/1986 |
| JP | 2-239265 | | 9/1990 |
| JP | 11065217 | A * | 3/1999 |
| JP | 2000-347499 | A | 12/2000 |
| JP | 2005-055593 | A | 3/2005 |
| JP | 2005-345536 | A | 12/2005 |

OTHER PUBLICATIONS

Machine Translation of JP-2005055593.*
A Notification of Reason for Refusal issued in corresponding Japanese Patent Application No. 2007-212885, mailed Sep. 8, 2009, and English translation thereof.
Chinese Office Action dated Apr. 6, 2011 issued in the corresponding Chinese Patent Application No. 200810147510.6 and English translation.

* cited by examiner

*Primary Examiner* — David Gray
*Assistant Examiner* — G.M. Hyder
(74) *Attorney, Agent, or Firm* — Buchanan Ingersoll & Rooney PC

(57) ABSTRACT

In a rotary type image developing apparatus that has a rotary rack accommodating a plurality of developer units and drives the rotary rack to rotate in a predetermined rotational direction so as to bring a targeted one of the developer units to a developing position, each developer unit includes a toner storage in which a first slope is disposed. As the rotary rack rotates, toner that remains upstream of a toner supply opening in a toner flowing direction in the toner storage is guided by a slope surface of the first slope, which enables the toner to be smoothly supplied to a developing chamber. Thus, even when the toner gets low, the toner can be efficiently supplied from the toner storage to the developing chamber with the aid of the first slope.

18 Claims, 9 Drawing Sheets

1

ROTARY DEVELOPING APPARATUS ROTATABLY ACCOMMODATING A PLURALITY OF DEVELOPER UNITS, DEVELOPER UNIT AND IMAGE FORMING APPARATUS INCLUDING ROTARY DEVELOPING APPARATUS

This application is based on application No. 2007-212885 filed in Japan, the content of which is hereby incorporated by references.

BACKGROUND OF THE INVENTION (1) Field of the Invention

The present invention relates to a rotary developing apparatus rotatably accommodating a plurality of developer units, a developer unit used in the developing apparatus, and an image forming apparatus having the developing apparatus.

(2) Description of the Related Art

An image forming apparatus includes a rotary developing apparatuses that accommodates developer units for respective toner colors of Cyan (C), Magenta (M), Yellow (Y), and Black (K) in a rotatable rack (hereinafter referred to as "rotary rack"), and that drives the rotary rack to rotate in order to bring a targeted one of the developer units to a designated developing position. The reduction in size and manufacturing cost has been demanded for image forming apparatuses provided with such rotary developing apparatuses. Accordingly, a simple and compact structure is demanded for the rotary developing apparatuses.

Usually, each developer unit has a toner storage and a developing chamber that receives toner from the toner storage and supplies the toner to a developing roller. However, for the purpose of the compact and simple structure mentioned as above, toner supply units tends to be omitted such as a stirring blade used for delivering the toner from the toner storage to the developing chamber. (Japanese Laid-Open Patent Application No. 2005-345536)

The simplified rotary developing apparatus works as follows. When one of the developer units is located within a predetermined rotational range as a result of the rotation of the rotary rack, the toner in the toner storage naturally falls into the developing chamber through an opening of a partition part (partition wall) between the toner storage and the developing chamber. Thus, the toner is supplied from the toner storage to the developing chamber.

FIG. 10 is an enlarged view of one of four development units accommodated in a rotary rack of a rotary developing apparatus that has been previously invented by the inventors of the present invention.

As shown in FIG. 10, a rotary rack 1032 has a rotation shaft 1033 and accommodates a plurality of developer units 1031 each storing toner of a given color (e.g. black). The rotary rack 1032 is driven to rotate about the rotation shaft 1033 in the direction of Arrow A.

Each developer unit 1031 has a toner storage 1311 that stores the toner therein and a developing chamber 1312 that is adjacent to the toner storage 1311 via a partition wall 1313. The developing chamber 1312 has a developing roller 1315 and a supply roller 1316.

When the developer unit 1031 reaches a position shown in FIG. 10 as a result of the rotation of the rotary rack 1032 (hereinafter referred to as "toner supply position"), the toner in the toner storage 1311 naturally falls into the developing chamber 1312 through a toner supply opening 1314 provided through the partition wall 1313. Thus, a given amount of the toner is supplied from the toner storage 1311 to the developing chamber 1312.

However, with the above structure of the developer unit 1031, there can be seen a significant degradation in performance of supplying the toner from the toner storage to the developing chamber 1312 when the toner remaining in the toner storage 1311 gets low.

More specifically, as the rotary rack 1032 rotates in the direction of Arrow A, the toner in the toner storage 1311 flows in the direction of Arrow B. As shown in FIG. 10, when there remains a small amount of the toner, a portion of the toner T remains in the corner 1311*c* upstream of the toner supply opening 1314 in the toner flowing direction in the toner storage 1311. Consequently, the toner is not sufficiently supplied to the developing chamber 1312.

As the rotary rack 1032 further rotates in the direction of Arrow A, the toner T remaining in a corner 1311*c* moves along an inner wall part 1311*b*, and falls through the toner supply opening 1314. However, it is only a small amount of the toner that falls. As the rotary rack 1032 rotates even further, a large portion of the toner T passes over the toner supply opening 1314 onto the partition wall 1313. Thus, the large portion of toner T does not fall into the developing chamber 1312.

When usable toner still remaining in the toner storage 1311 cannot be supplied to the developing chamber 1312, various problems including the following occur. The developer unit 1031 needs to be replaced earlier, which gives economical burden for users. In addition, in a case of executing job of forming monochrome images, a large number of sheets cannot be continuously printed, and therefore overall speed of image forming gets lower. Moreover, in a type of a printer that estimates, with use of a dot counter, the toner amount remaining in the developing chamber 1312 on the premise that a predetermined amount or more of the toner is supplied to the developing chamber 1312, the developing chamber 1312 becomes empty of the toner earlier than an estimated time, because a smaller amount of the toner is actually supplied from the toner storage 1311 to the developing chamber 1312 than the anticipated amount. Accordingly, the formed image can be scraped, and image deterioration may be caused.

SUMMARY OF THE INVENTION

The present invention is conceived in the light of the above problems. In the rotary developing apparatus that naturally supplies the toner from the toner storage to the developing chamber due to the rotation within a predetermined rotation range, it is an object of the present invention to minimize degradation in performance of supplying toner from the toner storage to the developing chamber when there remains a small amount of the toner in the toner storage.

The above object is fulfilled by a developing apparatus with the following features. The developing apparatus includes a plurality of developer units each having a toner storage that stores toner therein and a developing chamber, a rotary rack that accommodates the developer units therein, and a driver that drives the rotary rack to rotate in a predetermined rotational direction to bring a targeted one of the developer units to a developing position. As the rotary rack rotates in the rotational direction, the toner flows in a predetermined flowing direction in the toner storage. When the targeted developer unit is located within a predetermined range of the rotation, the toner is supplied from the toner storage to the developing chamber through a toner supply opening. In the developing apparatus, an inner wall of the toner storage that includes a first part and a second part with the toner supply opening located therebetween, and the first part is located upstream of the second part in the flowing direction. In a section that is orthogonal to a rotation axis of the rotary rack, the first part is sloped toward the second part at a first angle that is smaller than 180°.

Since the first angle smaller than 180° is formed between the first part located upstream of the toner supply opening in the toner flowing direction and the second part downstream of the toner supply opening in the toner flowing direction, the surfaces of the first and second parts serve as a funnel. Thus, especially when there remains a small amount of the toner, the toner remaining upstream of the toner supply opening in the toner flowing direction (hereinafter referred to as "residual toner") is more smoothly guided to the toner supply opening and supplied to the developing chamber by the rotation. Accordingly, the toner supply performance is improved.

The first angle desirably falls within a range of 120° to 160°, inclusive, which allows the residual toner to be guided into the developing chamber more effectively.

In addition, an edge of the first part toward the toner supply opening may extend to an interior of the developing chamber. Thanks to this arrangement, the residual toner can be securely supplied to the developing chamber. As a result, the toner supply performance is further improved when the toner gets low.

Furthermore, an inner wall of the developing chamber includes a third part and a fourth part with the toner supply opening located therebetween, and in the section that is orthogonal to the rotation axis of the rotary rack, the third part is sloped toward the fourth part at a second angle that is smaller than 180°.

This arrangement allows the toner to easily return from the developing chamber to the toner storage when the rotary rack is at a predetermined rotational position. Since the toner does not stay in the developing chamber for a long period of time, degradation of the toner can be prevented.

The second angle favorably falls within a range of 100° to 140°, inclusive, which improves the return performance of the toner from the developing chamber to the toner storage.

According to another aspect of the present invention, the image forming apparatus of the present invention has the above developing apparatus.

Furthermore, a developer unit is one of a plurality of developer units accommodated in a rotary rack of the developing apparatus that drives the rotary rack to rotate in a predetermined rotational direction to bring a targeted one of the developer units to a developing position. The developer unit includes a toner storage that stores toner therein, a developing chamber that is adjacent to the toner storage via a partition part, and a developing roller that is disposed in the developing chamber. The partition part has a toner supply opening through which the toner flows from the toner storage into the developing chamber. In the developer unit, an inner wall of the toner storage includes a first part and a second part with the toner supply opening located therebetween. In a section that is orthogonal to a rotation axis of the developing roll, the first part is sloped toward the second part at a first angle that is smaller than 180°.

When the developer unit with the above features is used in the rotary developing apparatus, the efficiency of supplying the residual toner can be improved similarly to the developing apparatus.

Furthermore, the developer unit has an inner wall of the developing chamber that includes a third part and a fourth part with the toner supply opening located therebetween. In the section that is orthogonal to the rotation axis of the rotary rack, the third part is sloped toward the fourth part at a second angle that is smaller than 180°. This feature promotes the toner to return from the developing chamber to the toner storage, and therefore the toner is not easily degraded.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

The following describes a developing apparatus and an image forming apparatus consistent with a preferred embodiment of the present invention with reference to the attached drawings. The description is given by way of example of a four-cycle full-color printer (hereinafter, referred to as simply "printer") using an intermediate transfer belt.

(1) Overall Structure of Printer

Figure 1:
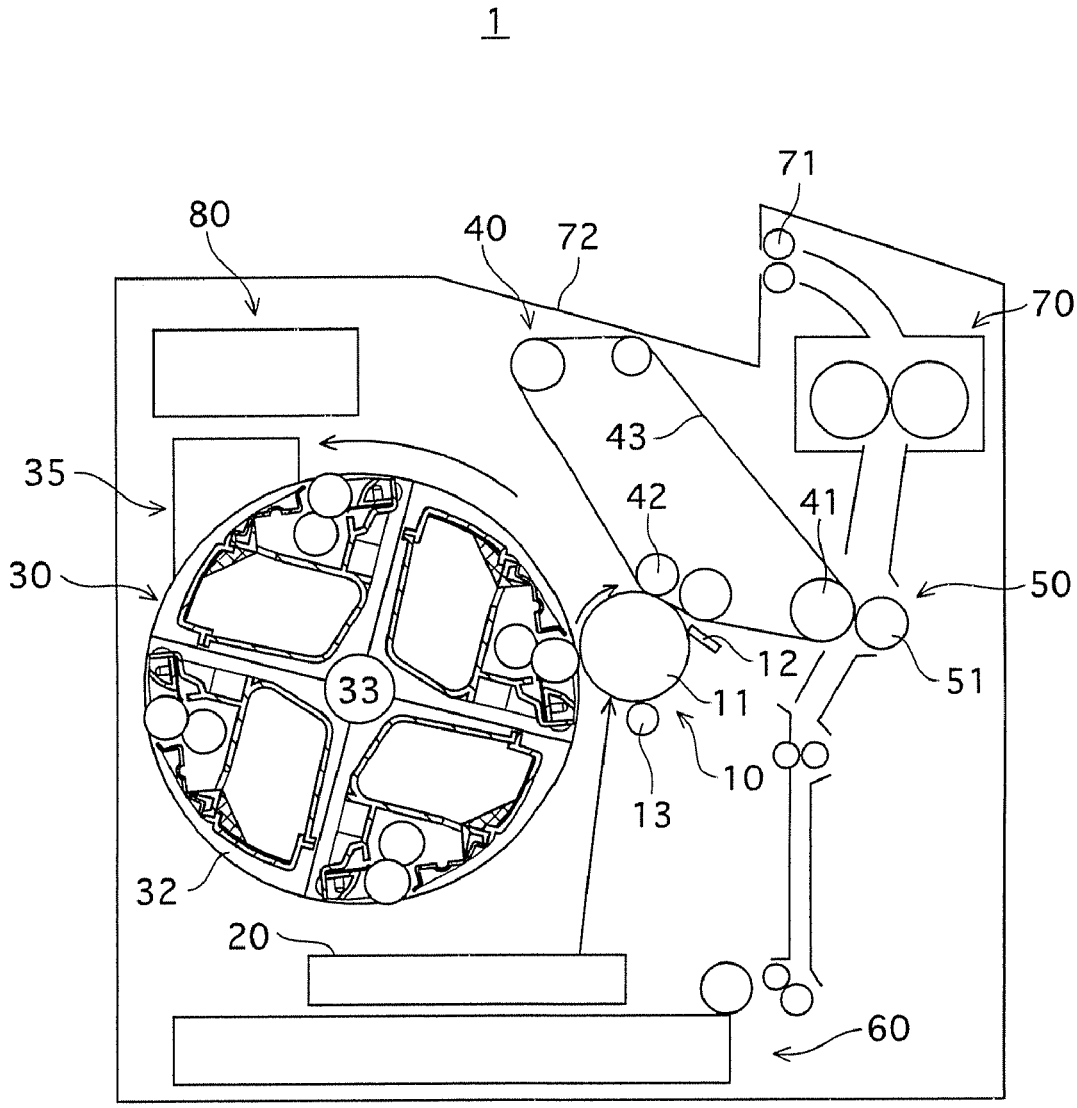
FIG. 1 is a view showing the structure of a printer in accordance with an embodiment of the present invention.

Referring initially to FIG. 1, there is shown a schematic view of the overall structure of a printer 1 in accordance with the embodiment of the present invention.

As shown in FIG. 1, the printer 1 has a photosensitive part 10, an exposure scanner 20, a developing part 30, an intermediate transfer part 40, a, secondary transfer part 50, a paper feeder 60, a fixing part 70, and a controller 80.

The photosensitive part 10 includes a photosensitive drum 11 that rotates in the direction of the arrow in FIG. 1. After residual toner is removed by a cleaning blade 12, the circumferential surface of the photosensitive drum 11 is uniformly charged by a charging roller 13, and is exposed to laser beams projected from the exposure scanner 20 to form an electrostatic latent image around the photosensitive drum 11.

The developing part 30 is of a rotary type, and FIG. 1 illustrates a cross-section in order to clearly show how the rotary rack 32 accommodates the developer units and the interior of each developer unit. (Other figures employ cross-sectional views as well for the same reason. Note that the toner in the developer units are not illustrated unless necessary.)

The electrostatic latent image formed around the photosensitive drum 11 is developed as a toner image by the developer unit of a corresponding color.

The intermediate transfer part 40 has an endless intermediate transfer belt 43 that is supported by a plurality of rollers including a driving roller 41. The driving roller 41 is controlled so that the intermediate transfer belt 43 runs at the same speed as the circumferential speed of the photosensitive drum 11.

The toner image formed around the photosensitive drum 11 is primarily transferred to the intermediate transfer belt 43 by a primary transfer roller 42.

Full-color image forming job is executed as follows. The processes of primary transfer of the respective colors of Y, M, C, and K are executed in sequence, and respective colors are superimposed onto the intermediate transfer belt 43. Subsequently in the secondary transfer part 50, a secondary transfer roller 51 secondarily transfer the image onto a sheet of paper (unshown) that is fed by the paper feeder 60 in a timed relationship with the rotation of the intermediate transfer belt 43. Then, after the fixing part 70 fixes the image on the sheet by heat, the sheet is ejected by ejection rollers 71 to an ejection tray 72.

On the other hand, when monochrome-image forming job using a black color is executed, only the developer unit of the black color is used to develop the image. The primary and secondary transfer operations are executed similarly to the above. When the image is fixed to a sheet of paper, the sheet is ejected.

The controller 80 is mainly composed of CPU, a communication interface, RAM, ROM and the like. The CPU performs necessary processing on image data according to a print job received from an external terminal via the communication interface. In addition, based on a program stored in the ROM, the CPU determines timing, and integrally controls the photosensitive part 10, the exposure scanner 20, the developing part 30, the intermediate transfer part 40, the secondary transfer part 50, the paper feeder 60 and the fixing part 70 to execute smooth image forming operation.

(2) Structure of Developing Part 30

Figure 2:
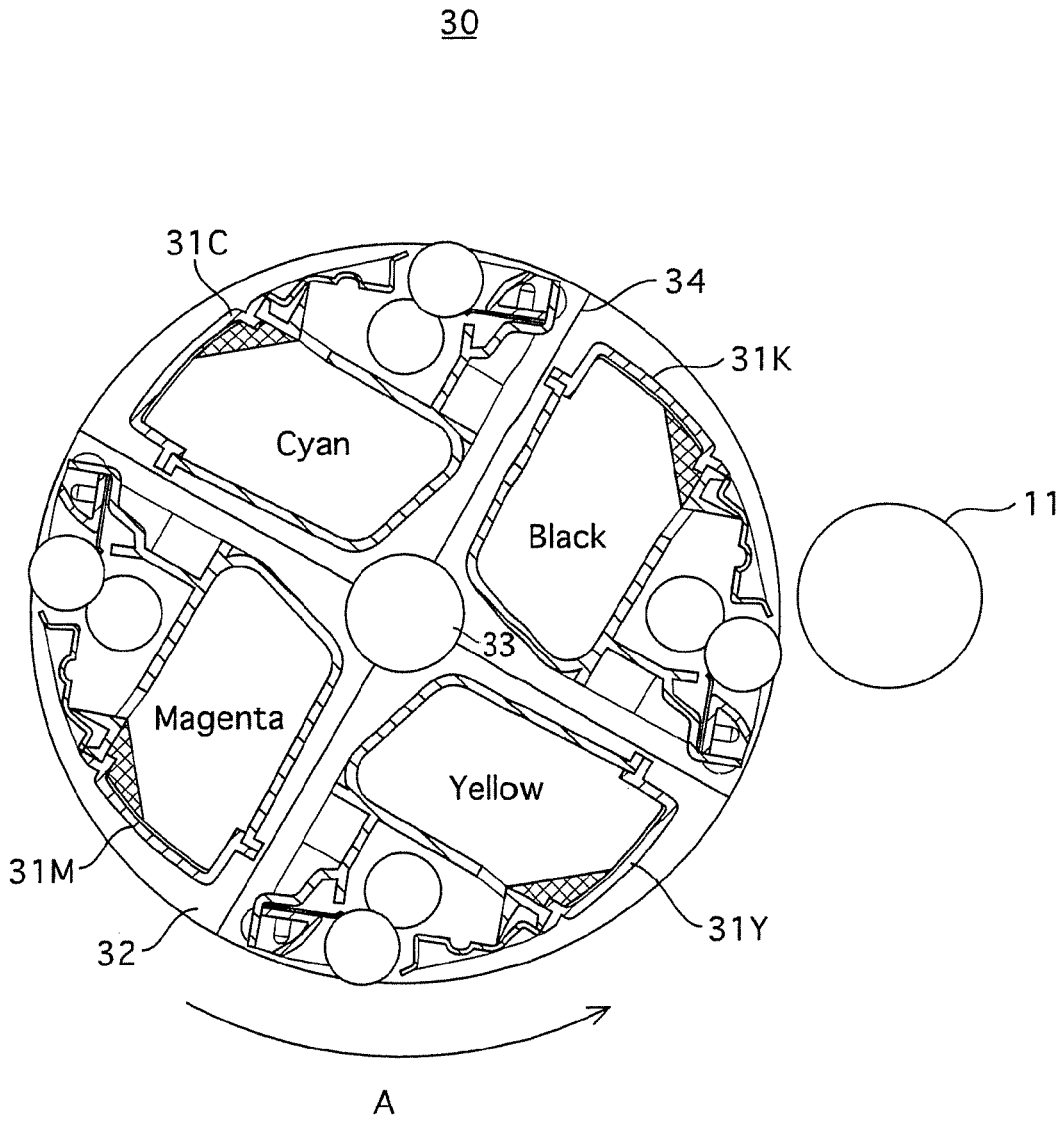
FIG. 2 is a view showing the structure of a rotary developing part included in the printer.

FIG. 2 is an enlarged view showing the structure of the developing part 30.

As shown in FIG. 2, the developing part 30 has a rotary rack 32 and developer units 31. The rotary rack 32 accommodates the developer units 31Y, 31M, 31C, and 31K that store toner of Y, M, C and K colors, respectively. The rotary rack 32 is rotated around a rotation shaft 33.

The rotary rack 32 is substantially cylindrical. The interior of the rotary rack 32 is divided into four chambers by four partition parts 34 each forms a right angle with one another. Each chamber accommodates a corresponding one of the developer units 31Y, 31M, 31C, and 31K.

The outer circumference of each chamber of the rotary rack 32 can be opened so that the developer units 31Y, 31M, 31C and 31K can be replaced with a new developer unit. (The structure of how to open or close the chamber is omitted.)

The rotary rack 32 is driven to rotate in the direction of Arrow A by a rotary rack driver 35 (shown in FIG. 1) whose driving source is a servomotor or a stepping motor that can easily control positioning.

Note that FIG. 2 shows the rotational position of the rotary rack 32 at which the black developer unit 31K is in a waiting position. In this embodiment, this waiting position is a home position, and the controller 80 controls the rotary rack driver 35 so as to move the developing roller of each developer unit to the developing position that is in the proximity to the photosensitive drum 11. Heretofore-known techniques are applied for controlling this positioning of the rotary rack 32.

Besides, for detecting the toner level in the developer unit, heretofore-known techniques, such as a detecting method with use of a dot counter, are applied.

More specifically, a heretofore-known dot counter (unshown) is provided in the controller 80. The dot counter counts the number of pixels (dots) that are to be printed in the bitmap data for every printed page, and transmits the counted value to the CPU in the controller 80.

The toner level can be detected by the CPU in the controller 80 as follows. The toner level is reset to a first default value when the developer unit is replaced with a new developer unit of a corresponding color. Every time when the counted value is transmitted from the dot counter to the CPU, the CPU decreases the first default value. The first default value of a new developer unit that shows the number of dots printable by the developer unit is determined by calculations or experiments, and is stored in the ROM in the controller 80.

The toner level in the developing chamber 312 is reset to a second default value every time when the rotary rack 32 goes into a 360-degree roll. The toner level in the developing chamber 312 can be known from the second default value being decreased every time when the counted value is notified to the CPU in the controller 80.

For example, according to the toner level in the developer chamber, the toner amount supplied from the toner storage 311 to the developing chamber 312 per rotation of the rotary rack 32 for 360 degrees is determined by calculations and experiments. The numbers of dots for printing a good image with use of an amount of toner slightly less than the above calculated toner amount are determined by calculations and experiments, and is stored in a table in the ROM. When resetting the toner level, the controller 80 determines the second default value based on the toner level and by referring to the table.

As a matter of course, instead of the dot counter, a heretofore-known photoelectric sensor can be installed in the toner storage 311 or the developing chamber 312 in order to detect the toner-empty state of the developing unit 31.

(3) Structure of Developer Unit

Figure 3:
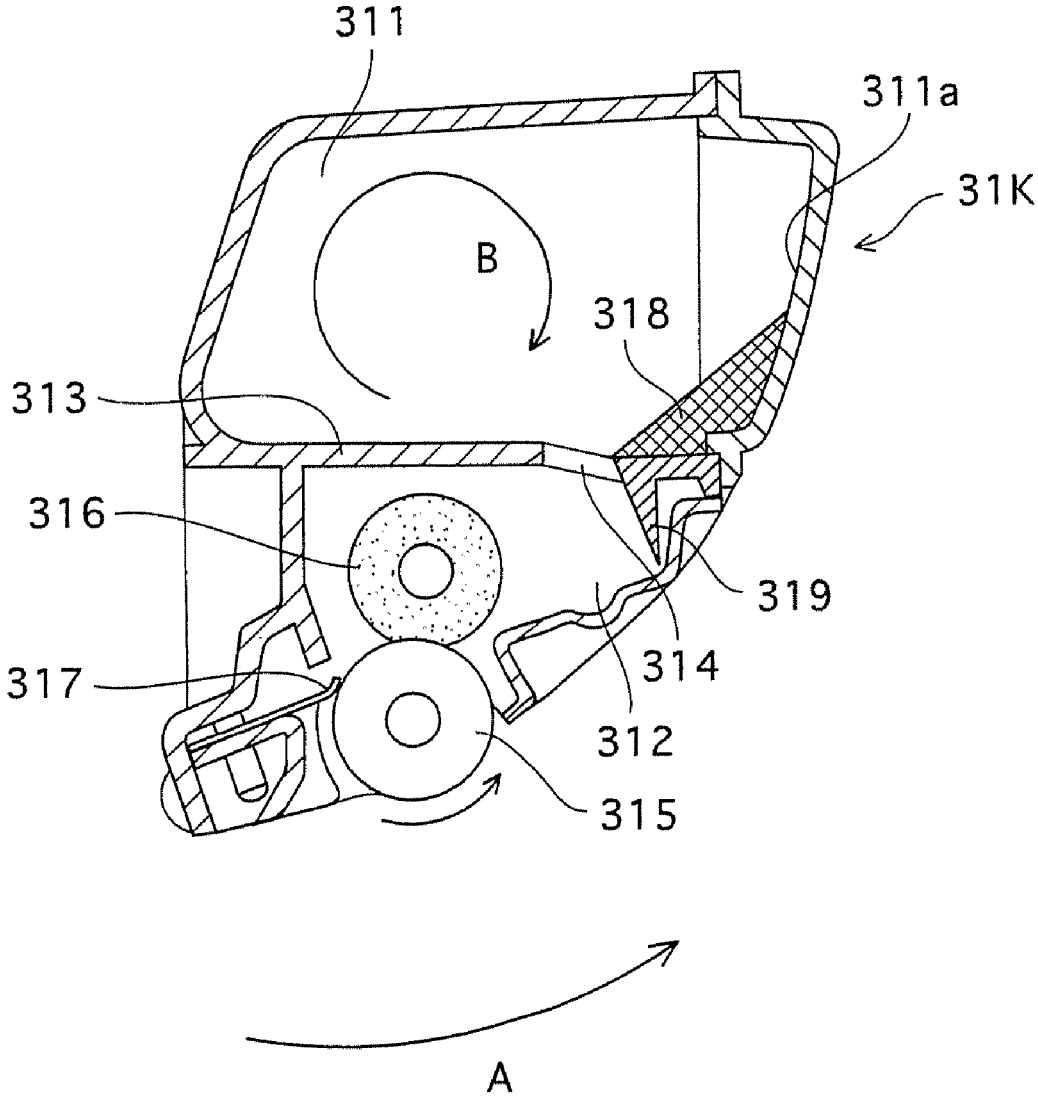
FIG. 3 is a cross-sectional view of a developer unit for black color included in the rotary developing part.

FIG. 3 shows a sectional view of the black developer unit 31K, the section taken along the plane that is orthogonal to the rotation shaft 33 of the rotary rack 32.

As shown in FIG. 3, the developer unit 31K includes a toner storage 311, a developer chamber 312 that is adjacent to the toner storage 311, a toner supply opening 314 of a partition wall 313 between the toner storage 311 and the developing chamber 312, a developing roller 315 that supplies toner to the surface of the photosensitive drum 11, a supply roller 316 that supplies the toner from the developing chamber 312 to the developing roller 315, a regulating blade 317 that makes a layer of the toner on the surface of the developing roller 315 be in a uniform thickness, a first slope 318 that allows a smooth flow of the residual toner from the toner storage 311 to the developing chamber 312, and a second slope 319 that allows a smooth return of the toner from the developing chamber 312 to the toner storage 311.

Both rotational shafts of the developing roller 315 and the supply roller 316 are arranged in parallel to the rotational shaft 33 of the rotary rack 32. The outer circumference of the supply roller 316 is made of a foamed elastic material such as a sponge, which enables the supply roller 316 to carry a large amount of toner. In addition, the distance between the shafts of the development roller 315 and the supply roller 316 can be a little shorter so that the area in which the developing roller 315 contacts with the supply roller 316 can be enlarged. Thus, with the above inventive features, toner can be more efficiently supplied to the developing roller 315.

Both rotational shafts of the developing roller 315 and the supply roller 316 project out from the surface of the developing chamber 312. The developing roller 315 and the supply roller 316 are driven to rotate in a predetermined direction by a publicly-known driving mechanism that is unshown in the figure. This driving mechanism is as follows, for example. At each projecting edge of the developing roller 315 and the supply roller 316, a spur gear or the like is fixed. When the developer unit 31K reaches the developing position, the spur gear is meshed with a gear connected to another driving source.

Each width of the developing roller 315 and the supply roller 316 is substantially equal to the width of the photosensitive surface of the photosensitive drum 11 in the axial direction. The length of the toner supply opening 314 in a direction parallel to the axis of the supply roller 316 is also the same as each width of the developing roller 315 or the supply roller 316.

Each width of the first slope 318 and the second slope 319 in the direction parallel to the axis of the supply roller 316 (hereinafter referred to simply as "rotation axis direction") is equals to the width of each inner wall of the toner storage 311 and the developing chamber 312 in the rotation axis direction. The first slope 318 and the second slope 319 are fixed to the respective positions of the inner wall by an adhesive agent or the like.

Note that other developer units 31Y-31C have the identical structure with the developer unit 31K except for the toner color.

(4) First Slope 318

As mentioned above, the first slope 318 is fixed on the inner wall of the toner storage 311 located upstream of the toner supply opening 314 in the toner flowing direction (Arrow B direction). Thus, the toner storage 311 does not have the corner 1311*c* where the toner remains in the conventional structure shown in FIG. 10. In addition, when the developer unit 31K is in the toner supply position, the toner remaining around an inner wall part 311*a* slides down the slope surface of the first slope 318 toward the toner supply opening 314.

Figure 4:
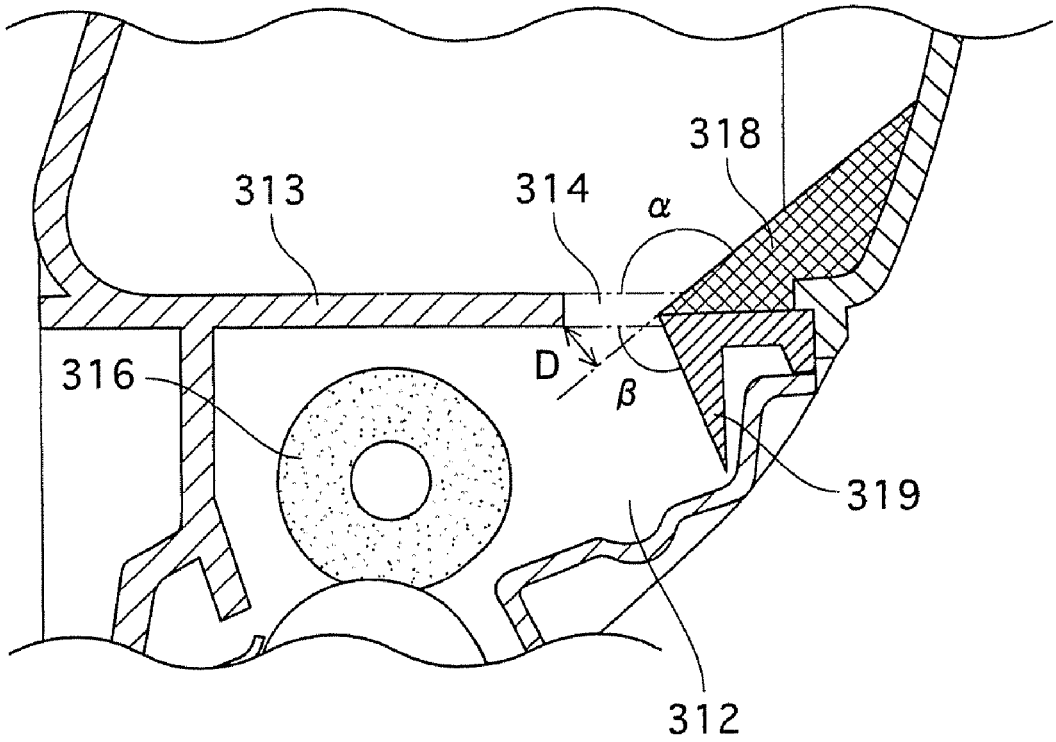
FIG. 4 is an enlarged view of the vicinity of a toner supply opening of the developer unit.

As shown in the partially enlarged view of FIG. 4, the angle $\alpha$ is formed between the slope surface of the first slope 318 and the surface of the partition wall 313 with the toner supply opening 314 located therebetween, and the imaginary extension of the slope surface of the first slope 318 is below the edge of the partition wall 313. Accordingly, the distance D shown in FIG. 4 is secured between the imaginary extension of the slope surface and the partition wall 313. As a result, the toner that slides down the slope surface of the first slope 318 can flow into the developing chamber 312 without being hindered from the partition wall 313.

The angle $\alpha$ is angled at 140° in this embodiment.

Note that the width of the toner supply opening 314 in the direction orthogonal to the rotation axis direction is 5 mm. The desirable position of the toner supply opening 314 is as follows. When the developer unit 31 arrives at the developing position (a position where the developing roller 315 comes closest to the circumference of the photosensitive drum 11 as the developing part 30 is further rotated in the direction of Arrow A than that shown in FIG. 2), the partition wall 313 is substantially vertical. Under this positional relation, the edge of the partition wall 313 toward the toner supply opening 314 is positioned higher than the top of the circumferential surface of the supply roller 316.

A portion of the toner once flows into the developing chamber 312 at the toner supply position, and later flows back into the toner storage 311 through the toner supply opening 314 at the developing position. From the standpoint of the stable toner supply to the developing roller 315, it is thus desirable that the top of the toner in the developing chamber 312 is above the supply roller 316 and that the supply roller 316 is completely sunk in the toner. In addition, the higher the position of the toner supply opening 314 is, the more toner the developing chamber 312 can store therein. Thus, numerous monochrome images can be formed continuously when monochrome image forming job is executed.

Figure 5A:
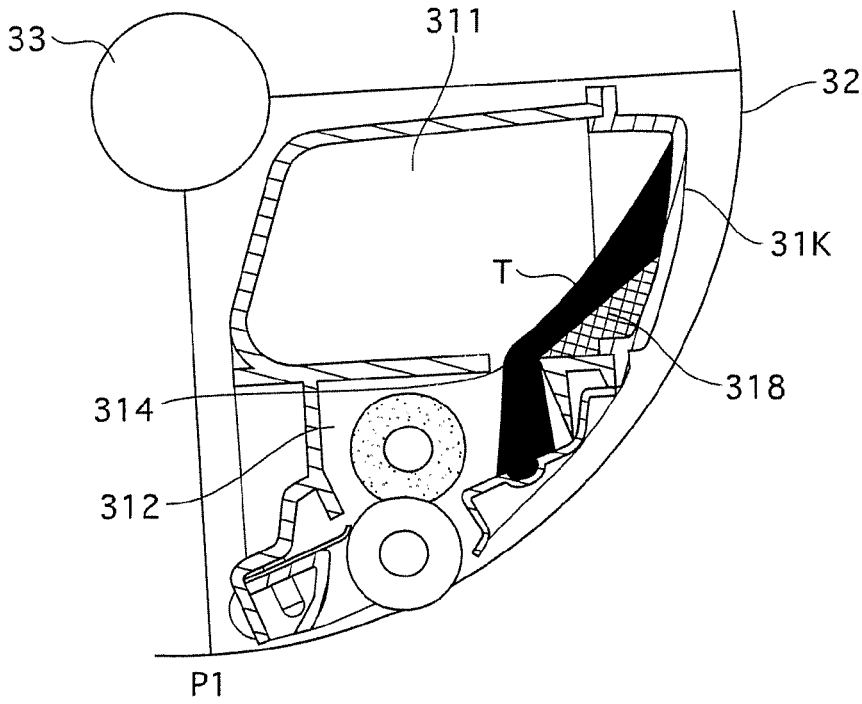
FIGS. 5A and 5B each show that toner is smoothly supplied from a toner storage to a developing chamber with the aid of a first slope when there remains a small amount of toner in the toner storage.

FIG. 5A shows that the toner is being supplied to the developing chamber 12 when there remains a small amount of toner in the toner storage 311.

As shown in FIG. 5A, when the developer unit 31K reaches the toner supply position P1 as the rotary rack 32 rotates, the toner that remains around the inner wall part 311*a* of the toner storage 311 slides down the slope surface of the first slope 318 to the developing chamber 312 through the toner supply opening 314. Thus, the toner is efficiently supplied. In addition, almost all of the toner in the toner storage 311 can be supplied to the developing chamber 312, which is very economical.

Figure 5B:
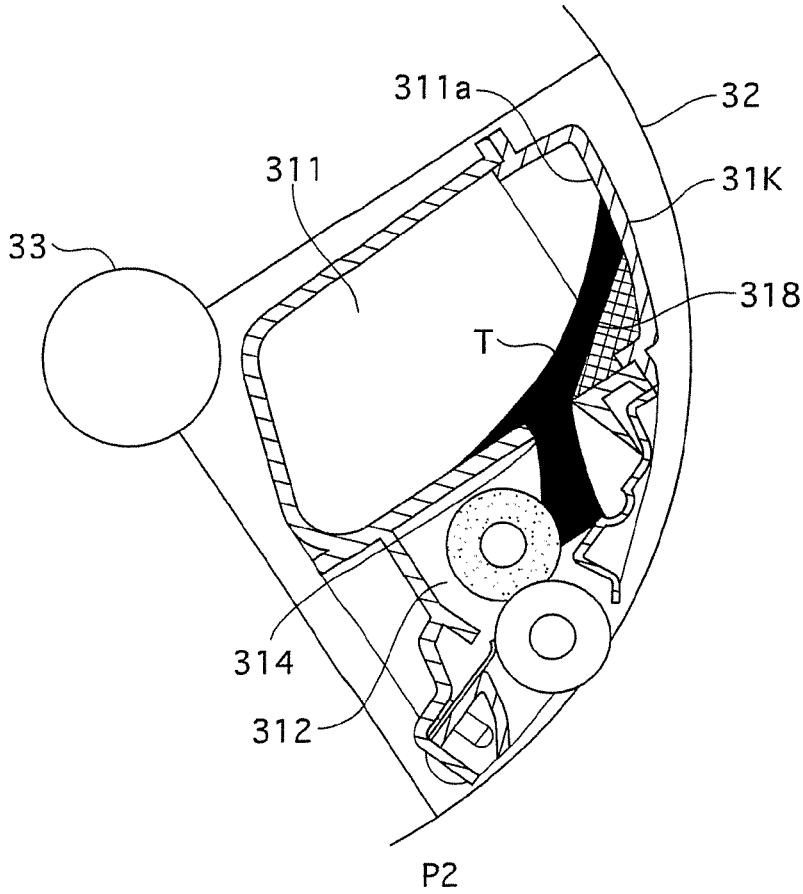

Furthermore, when the developer unit 31K reaches the toner supply position P2 shown in FIG. 5B by further rotating the rotary rack 32, the slope surface of the first slope 318 slopes at a little steeper angle with the horizontal direction. Then, the toner accumulated on the inner wall part 311*a* of the toner storage 311 even more smoothly slides down the slope surface of the first slope 318 into the developing chamber 312. Thus, the toner can be even more stably supplied to the developing chamber 312 than that with the conventional structure.

Figure 6:
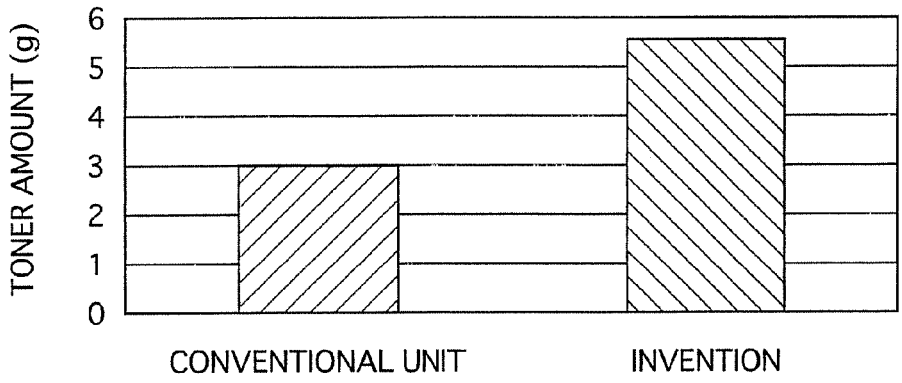
FIG. 6 is a graph showing a comparative result between a conventional unit and the present invention of an amount of toner supplied to the developing chamber per full 360 degree rotation of a rotary rack in a low toner level condition.

FIG. 6 shows the results of comparative experiment that shows improvement in the toner supply efficiency in the embodiment of the present invention.

Figure 10:
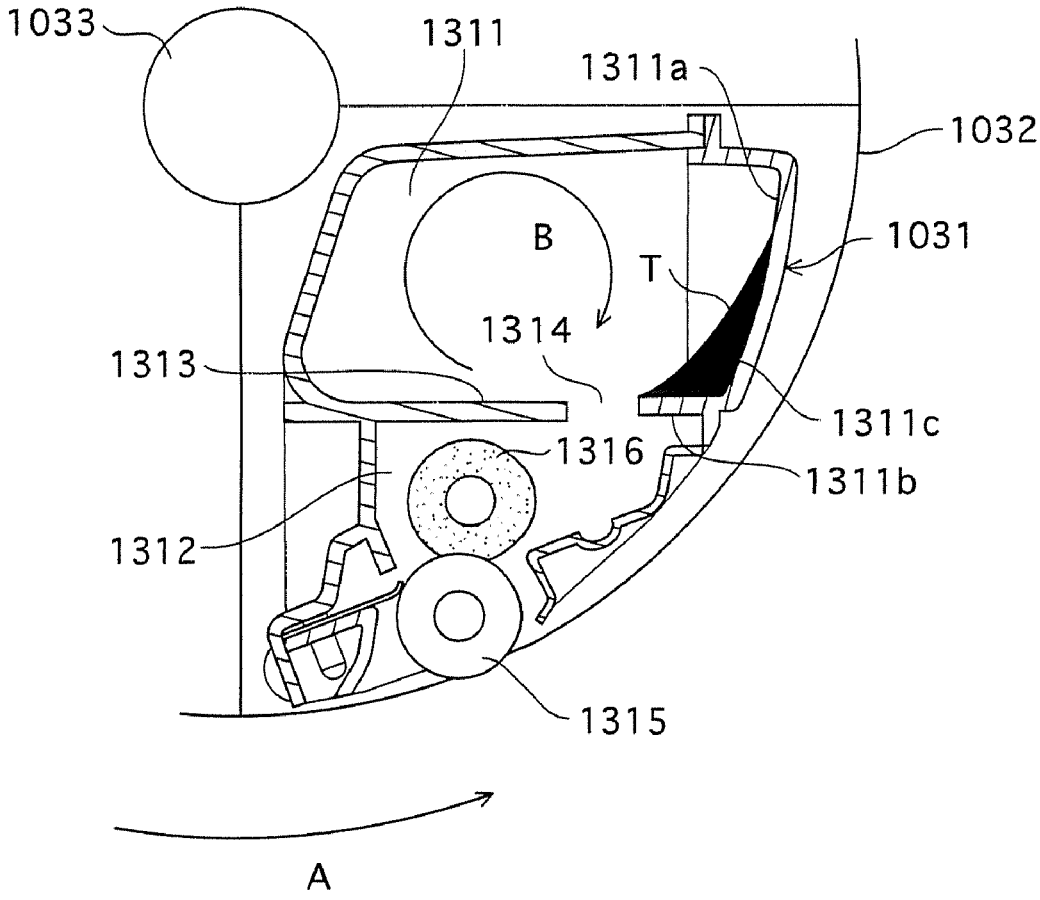
Prior Art FIG.10
FIG. 10 is a cross-sectional view of the shape of a conventional developer unit.

In the experiment, a conventional developer unit as shown in FIG. 10 (hereinafter referred to as "conventional unit") and the developer unit of the embodiment of the present invention as shown in FIG. 3 (hereinafter referred to as "present invention") are used. As shown in FIG. 10, the conventional unit does not have the first slope in the toner storage 1311, and the surfaces of the partition wall 1313 toward the toner storage 1311 is substantially flush with the surface of the inner wall part 1311*b* toward the toner storage 1311.

The conventional unit and the present invention have the structure substantially identical with each other except for the presence of the first slope 318. Each developer unit can store 60 g of toner in the toner storage.

The experimental results shown in FIG. 6 were obtained by measuring amounts of the toner supplied to the developing chamber when the rotary rack 32 was rotated for 360 degrees at a speed of 70 rpm which was substantially equal to the rotary speed of a commercial product. The total amount of the toner that had been stored in the developer unit was approximately 9 g.

As shown in the graph of FIG. 6, the conventional unit can only supply 3 g of the toner to the developing chamber 312. However, the present invention can supply approximately 5.5 g of the toner, which shows a 1.8-fold increase of the toner supply amount compared with the conventional unit.

Figure 7:
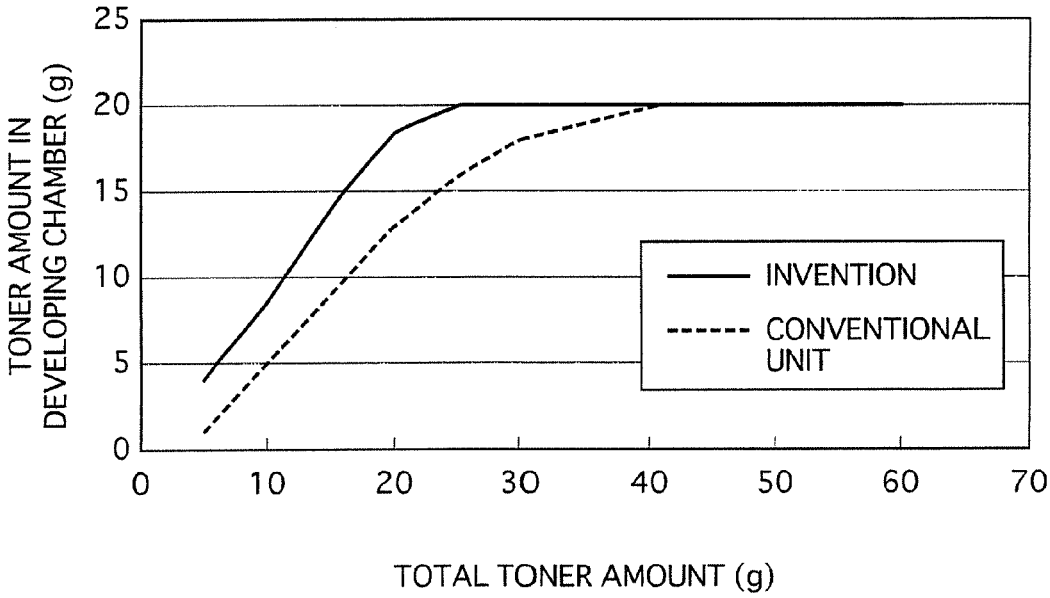
FIG. 7 is a graph showing a comparative result between the conventional unit and the present invention of a relation between the amount of residual toner and the amount of supplied toner after the rotation of the rotary rack for 360 degrees.

FIG. 7 is a graph showing experimental results obtained by measuring the amount of the toner in the developing chamber while changing the total, amount of the toner in the developer unit. The horizontal axis shows the total amount of the toner, and the vertical axis shows the amount of the toner that is supplied to the developing chamber.

In the conventional unit, the toner amount supplied to the developing chamber starts to decrease when the total toner amount decreases to approximately 40 g or below. However, in the present invention, a constant amount (20 g) of the toner is supplied till the total toner amount decreases to 25 g or below. Although the toner supply amount decreases when the total toner amount decreases below 25 g, the present invention constantly supplies a larger amount of toner than the conventional unit.

Note that if the angle α formed between the slope surface of the first slope 318 and the surface of the partition wall 313 toward the toner storage 311 is any smaller than 180°, it is ensured that the toner is any more efficiently supplied to the developing chamber than the conventional unit shown in FIG. 10. However, the angle α that is 160° or below is preferable for more efficient and stable toner supply.

On the contrary, when the slope surface rises thereby making the angle α too sharp, the volume of the toner storage 311 becomes small, which causes the inconvenience that developer unit replacement is required more frequently. In addition, the residual toner locally exists in the vicinity of the inner wall part 311*a* of the toner storage 311 may rush into the developing chamber 312. Then, a packing, which is a phenomenon in which toner is agglutinated because of the force (impact) exerted on the toner, can easily occur. This packing hinders smooth toner supply to the developing roller 31, and may cause developing defects. Thus, from such a point of view, the angle α is desirably 120° and over.

Experiments were repeatedly conducted with changing the angle α within a range of $120° \leqq \alpha \leqq 160°$. Even if there remains a small amount of toner in the toner storage 311, according to the experimental results, the present invention shows no packing, supplies a larger toner amount than the conventional unit, and shows few variances in the toner supply amount.

(5) Second Slope 319

The toner in each developer unit is stirred by the rotation of the rotary rack 32. A long-term stir of the toner may separate additives from the toner particle, and thus the toner can be deteriorated. The additives such as silica are attached to the surface of a toner particle as a lubricant As the toner deterioration changes its charging characteristics and the like, an excellent image cannot be reproduced. Especially in the developing chamber 312, since the developing roller 315 and the supply roller 316 rotate, and furthermore the regulating blade 317 scrubs away the superfluous toner formed on the surface of the developing roller 315, the toner in the developing chamber 312 deteriorates more than that stored in the toner storage 311.

Therefore, it is desirable that the toner is regularly returned from the developing chamber 312 to the toner storage 311, which prevents the same toner from staying in the developing chamber 312 for a long period of time.

In the developing part 30 of a rotary type, when the developing chamber 312 is above the toner storage 311 as the rotary rack 32 rotates, the toner in the developing chamber 312 returns to the toner storage 311 through the toner supply opening 314.

Figure 8:
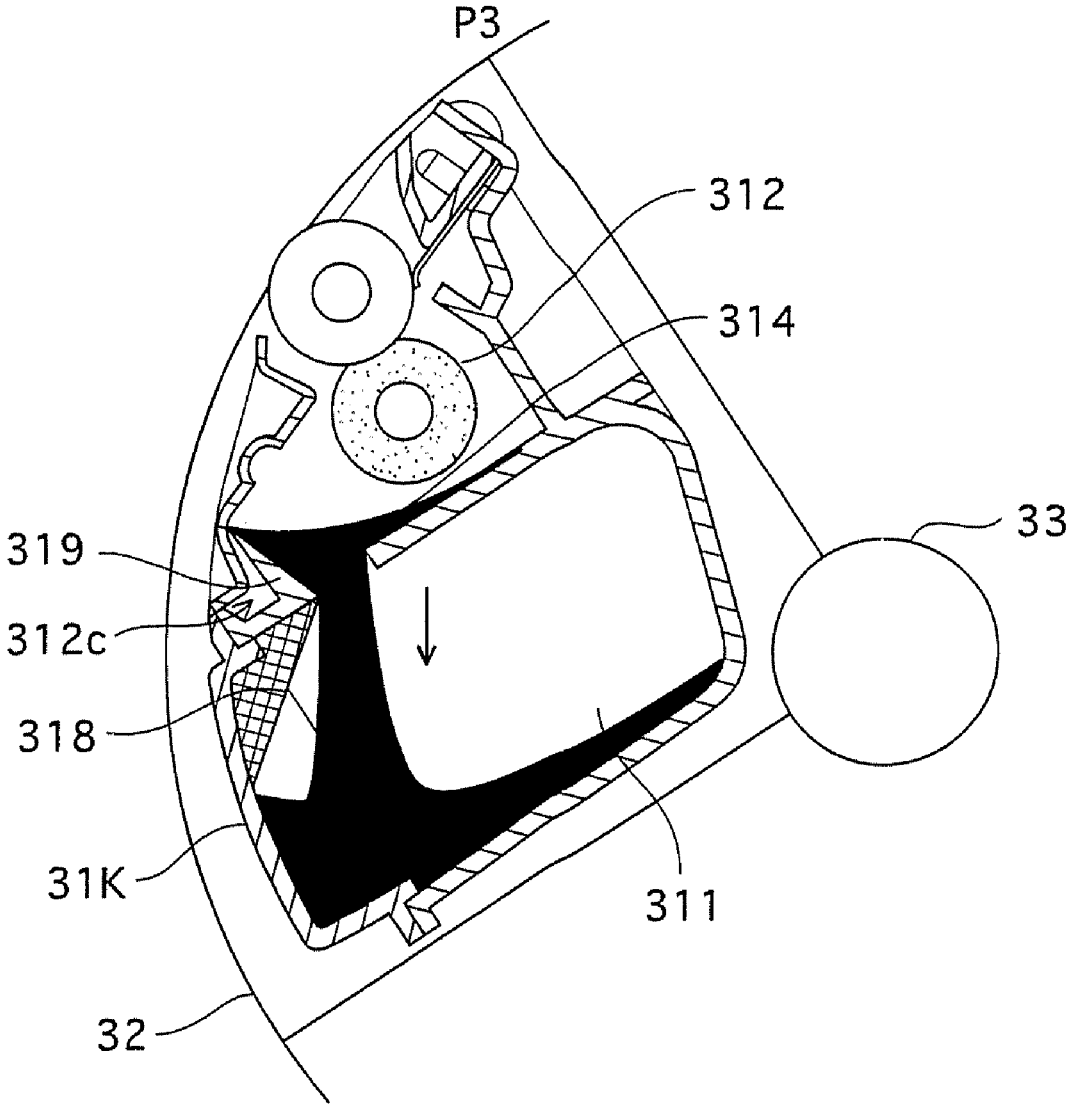
FIG. 8 is a view showing the effect of a second slope that aids the toner to return from the developing chamber to the toner storage.

In the embodiment of the present invention, the second slope 319 is provided in a corner 312*c* of the developing chamber 312 (the counterpart position of the first slope 318 via the toner supply opening 314) that is radially outward in the rotary rack 32. As shown in FIG. 8, when the developer unit 31K arrives at the rotation position P3, the toner in the developing chamber 312 smoothly flows back to the toner storage 311.

In the conventional unit as shown in FIG. 10, the developing chamber 312 does not have a part that corresponds to the second slope 319. As a result, a portion of the toner having flown into the corner 312*c* does not flow back to the toner storage 311, thereby getting more deteriorated. When this deteriorated toner is supplied to the developing roller 315, this toner cannot sufficiently contributes to develop electrostatic latent image having been formed around the photosensitive drum 11, and thus can result in image deterioration. However, the embodiment of the present invention can lower the risk of such image deterioration.

In this embodiment, the angle β (See FIG. 4) formed by the slope surface of the second slope 319 with the surface of the partition wall 313 of the developing chamber 312 is set to 115°. Note that the angle β is never limited to such a value.

As a matter of course, it is desirable that the angle β falls within a given range from the point of view similar to the angle α. Empirically, the angle β desirably falls within a range of $100° \leqq \beta \leqq 140°$.

<Modification>

The present invention is described based on the above embodiment. The present invention is never limited to the above embodiment, and various modifications can be made as follows.

Figure 9:
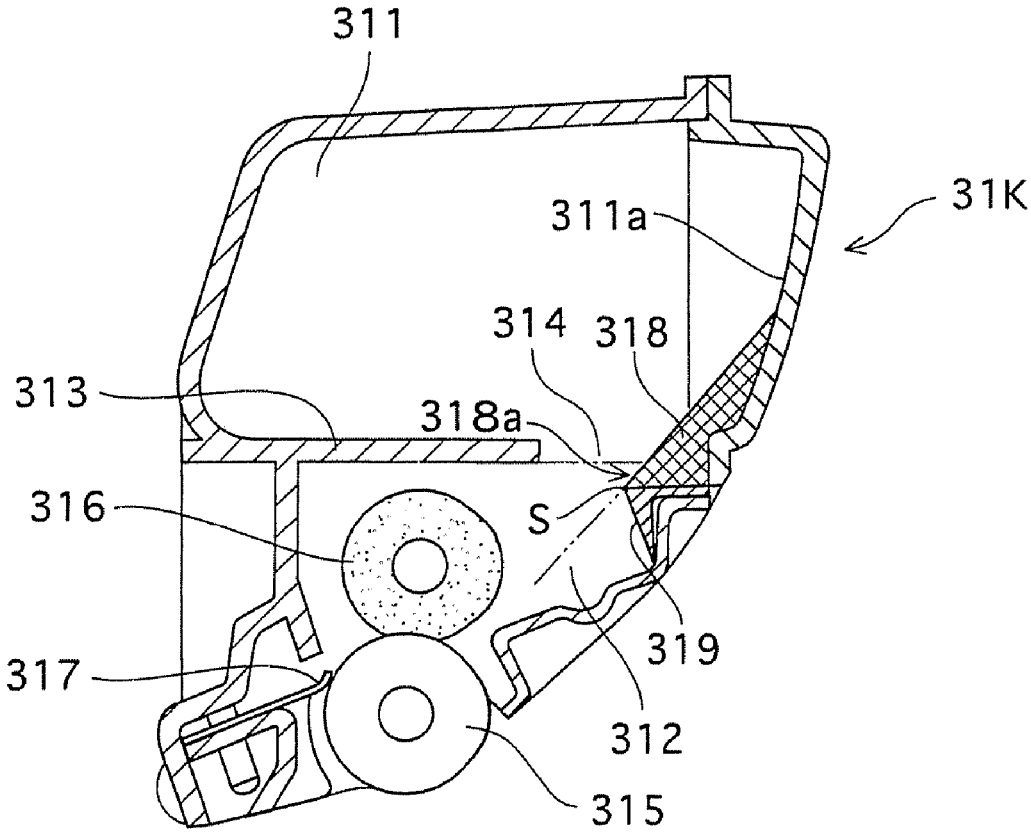
FIG. 9 is a view showing the structure of a developer unit in accordance with a modification of the present invention.

(1) The above embodiment describes a case that one edge of the first slope 318 toward the toner supply opening 314 is substantially at the imaginary extension of the partition wall 313. As shown in FIG. 9, however, the structure may be modified as follows. The slope surface of the first slope 318 may extend with its edge S toward the toner supply opening 314 extending to the interior of the developing chamber 312. As shown in FIG. 9, an extension part 318*a* of the slope surface of the first slope 318 is between the edge S and an edge of the extension of the partition wall 313. With the extension part 318*a*, the toner remaining around the inner wall part 311*a* can be reliably guided to the interior of the developing chamber 312. Thus, when the slope surface of the first slope 318 extends to the interior of the developing chamber 312, the toner can be more efficiently supplied to the developing chamber 312.

In addition, when the developer unit 31K arrives at a position shown in FIG. 8 as the rotary rack 32 rotates, the toner that flows along the surface of the partition wall 313 in the developing chamber 312 meets the extension part 318*a*. Then, the toner is naturally flown into the toner storage 311 being guided by the first slope 318. Thus, the return performance of the toner from the developing chamber 312 to the toner storage 311 is improved.

(2) In the above embodiment, the first slope 318 is separately manufactured from the toner storage 311, and is mounted on the inner wall of the toner storage 311 that is the corner part upstream from the toner supply opening 314. However, the following modification can be made that the toner storage 311 and the first slope 318 are integrally formed, and the inner wall of the toner storage 311 may have a shape equivalent to the first slope 318. The same structure can be applied to the second slope 319 in the developing chamber 312.

(3) In the above embodiment, each slope surface of the first slope 318 and the second slope 319 is described on the premise that each slope surface is flat. However, each slope surface may be curved in some degree as long as the curve does not hinder the toner flow. Similarly, both surfaces of the partition wall 313 toward the toner storage 311 and the developing chamber 312 may be curved as well.

(4) In the above embodiment, the first slope 318 is formed on the inner wall of the toner storage 311 that is in the direction of the imaginary extension of the partition wall 313. However, a modification may be made as follows. A new partition wall that has a basically identical structure with the partition wall 313 may be formed on the inner wall part 311*a* that extends in a direction to the toner supply opening 314, and anew slope surface that is angled at $\alpha$ with the new partition wall may be formed on the original partition wall 313. Since these new partition wall and the new slope surface serve as a funnel, this modification can improve the supplying performance than the conventional unit.

(5) In the above embodiment, a full-color printer is given by way of example of the image forming apparatus in accordance with the present invention. However, the image forming apparatus in accordance with the present invention may be a copy machine or a color facsimile apparatus having the printer, or a complex machine having all these functions.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A developing apparatus comprising:

a plurality of developer units each having a toner storage that stores toner therein and a developing chamber including a supply roller and a developing roller;

a rotary rack that accommodates the developer units therein; and a driver that drives the rotary rack to rotate in a predetermined rotational direction to bring a targeted one of the developer units to a developing position, wherein as the rotary rack rotates in the rotational direction, the toner flows in a predetermined flowing direction in the toner storage, when the targeted developer unit is located within a predetermined range of the rotation, the toner is supplied from the toner storage to the developing chamber through a toner supply opening, an inner wall of the toner storage includes a first part and a second part with the toner supply opening located therebetween, the first part being located upstream of the second part in the flowing direction, and the second part being stationary with respect to the first part during rotation of the rotary rack and having an edge adjacent the toner supply opening that is closer to the first part than outer surfaces of the supply roller and the developing roller, and in a plane that is orthogonal to a rotation axis of the rotary rack, the first part is sloped downward in the developing position from an upstanding side wall inside the toner storage toward the second part in a direction which the toner is supplied into the toner supply opening before entering the developing chamber, the first part being sloped at a first angle that is smaller than 180° .

2. The developing apparatus of claim 1, wherein the first angle falls within a range of 120° to 160° , inclusive.

3. The developing apparatus of claim 1, wherein an edge of the first part toward the toner supply opening extends to an interior of the developing chamber.

4. The developing apparatus of claim 1, wherein an inner wall of the developing chamber includes a first part and a second part with the toner supply opening located therebetween, and in a plane that is orthogonal to the rotation axis of the rotary rack, the first part of the inner wall of the developing chamber is sloped toward the second part of the inner wall of the developing chamber at a second angle that is smaller than 180° .

5. The developing apparatus of claim 1, wherein the second angle falls within a range of 100° to 140° , inclusive.

6. The developing apparatus of claim 1, wherein the toner supply opening opens into the developing chamber at an upper periphery of the developing chamber in the developing position.

7. An image forming apparatus having a developing apparatus, the developing apparatus comprising:

a plurality of developer units each having a toner storage that stores toner therein and a developing chamber including a supply roller and a developing roller;

a rotary rack that accommodates the developer units therein; and a driver that drives the rotary rack to rotate in a predetermined rotational direction to bring a targeted one of the developer units to a developing position, wherein as the rotary rack rotates in the rotational direction, the toner flows in a predetermined flowing direction in the toner storage, when the targeted developer unit is located within a predetermined range of the rotation, the toner is supplied from the toner storage to the developing chamber through a toner supply opening, an inner wall of the toner storage includes a first part and a second part with the toner supply opening located therebetween, the first part being located upstream of the second part in the flowing direction, and the second part being stationary with respect to the first part during rotation of the rotary rack and having an edge adjacent the toner supply opening that is closer to the first part than outer surfaces of the supply roller and the developing roller, and in a plane that is orthogonal to a rotation axis of the rotary rack, the first part is sloped downward in the developing position from an upstanding side wall inside the toner storage toward the second part in a direction which the toner is supplied into the toner supply opening before entering the developing chamber, the first part being sloped at a first angle that is smaller than 180° .

8. The image forming apparatus of claim 7, wherein the first angle falls within a range of 120° to 160° , inclusive.

9. The image forming apparatus of claim 7, wherein an edge of the first part toward the toner supply opening extends to an interior of the developing chamber.

10. The image forming apparatus of claim 7, wherein an inner wall of the developing chamber includes a first part and a second part with the toner supply opening located therebetween, and in a plane that is orthogonal to the rotation axis of the rotary rack, the first part of the inner wall of the developing chamber is sloped toward the second part of the inner wall of the developing chamber at a second angle that is smaller than 180° .

11. The image forming apparatus of claim 6, wherein the second angle falls within a range of 100° to 140° , inclusive.

12. The image forming apparatus of claim 7, wherein the toner supply opening opens into the developing chamber at an upper periphery of the developing chamber in the developing position.

13. A developer unit being one of a plurality of developer units accommodated in a rotary rack of a developing apparatus, the developing apparatus driving the rotary rack to rotate in a predetermined rotational direction to bring a targeted one of the developer units to a developing position, the developer unit comprising:

a toner storage that stores toner therein;

a developing chamber that is adjacent to the toner storage via a partition part; and a developing roller and a supply roller that are disposed in the developing chamber, wherein the partition part has a toner supply opening through which the toner flows from the toner storage into the developing chamber, an inner wall of the toner storage includes a first part and a second part with the toner supply opening located therebetween, the second part being stationary with respect to the first part during rotation of the rotary rack and having an edge adjacent the toner supply opening that is closer to the first part than outer surfaces of the supply roller and the developing roller, and in a plane that is orthogonal to a rotation axis of the developing roller, the first part is sloped downward in the developing position from an upstanding side wall inside the toner storage toward the second part in a direction which the toner is supplied into the toner supply opening before entering the developing chamber, the first part being sloped at a first angle that is smaller than 180° .

14. The developer unit of claim 13, wherein the first angle falls within a range of 120° to 160° , inclusive.

15. The developer unit of claim 13, wherein an edge of the first part toward the toner supply opening extends to an interior of the developing chamber.

16. The developer unit of claim 13, wherein an inner wall of the developing chamber includes a first part and a second part with the toner supply opening located therebetween, and in a plane that is orthogonal to the rotation axis of the rotary rack, the first part of the inner wall of the developing chamber is sloped toward the second part of the inner wall of the developing chamber at a second angle that is smaller than 180° .

17. The developer unit of claim 13, wherein the second angle falls within a range of 100° to 140° , inclusive.

18. The developer unit of claim 13, wherein the toner supply opening opens into the developing chamber at an upper periphery of the developing chamber in the developing position.

* * * * *